US005679043A

United States Patent [19]

Kumar

[11] Patent Number: 5,679,043

[45] Date of Patent: Oct. 21, 1997

[54] METHOD OF MAKING A FIELD EMITTER

[75] Inventor: Nalin Kumar, Canyon Lake, Tex.

[73] Assignees: Microelectronics and Computer Technology Corporation; SI Diamond Technology, Inc., both of Austin, Tex.

[21] Appl. No.: 457,962

[22] Filed: Jun. 1, 1995

Related U.S. Application Data

[63] Continuation-in-part of Ser. No. 993,863, Dec. 23, 1992, abandoned, which is a continuation-in-part of Ser. No. 851,701, Mar. 16, 1992, abandoned, and a continuation of Ser. No. 300,771, Jun. 20, 1994.

[51] Int. Cl.[6] ..... H01J 1/30; H01J 9/02

[52] U.S. Cl. ..... 445/24; 445/51

[58] Field of Search ..... 445/51, 24

[56] References Cited

U.S. PATENT DOCUMENTS

| | | |
|---|---|---|
| 1,954,691 | 4/1934 | Hendrick de Boer et al. . |
| 2,851,408 | 9/1958 | Cerulli et al. . |
| 2,867,541 | 1/1959 | Coghill et al. . |

(List continued on next page.)

FOREIGN PATENT DOCUMENTS

| | | | |
|---|---|---|---|
| 88 07288 | 12/1989 | France . | |
| 2-247939 | 10/1990 | Japan | 445/51 |

OTHER PUBLICATIONS

"A New Vacuum–Etched High–Transmittance (Antireflection) Film," *Appl. Phys. Lett.*, pp. 727–730.

"Cone Formation as a Result of Whisker Growth on Ion Bombarded Metal Surfaces," *J. Vac. Sci. Technol.* A 3(4), Jul./Aug. 1985, pp. 1821–1834.

"Cone Formation on Metal Targets During Sputtering," *J. Appl. Physics*, vol. 42, No. 3, Mar. 1, 1971, pp. 1145–1149.

"Control of Silicon Field Emitter Shaper with Isotrophically Etched Oxide Masks," Dec. 1989.

"Interference and Diffraction in Globular Metal Films," J. Opt. Soc. Am., vol. 68, No. 8, Aug. 1978, pp. 1023–1031.

"Physical Properties of Thin Film Field Emission Cathodes," *J. Appl. Phys..*, vol. 47, 1976, p. 5248.

"Topography: Texturing Effects," *Handbook of Ion Beam Processing Technology*, No. 17, pp. 338–361.

"A Comparative Study of Deposition of Thin Films by Laser Induced PVD with Femtosecond and Nanosecond Laser Pulses," *SPIE*, vol. 1858 (1993), pp. 464–475.

"Amorphic Diamond Films Produced by a Laser Plasma Source," *Journal Appl. Physics*, vol. 67, No. 4, Feb. 15, 1990, pp. 2081–2087.

"Characterization of Laser Vaporization Plasmas Generated for the Deposition of Diamond–Like Carbon," *J. Appl. Phys.*, vol. 72, No. 9, Nov. 1, 1992, pp. 3966–3970.

"Cold Field Emission From CVD Diamond Films Observed in Emission Electron Microscopy," 1991.

"Current Display Research—A Survey," Zenith Radio Corporation.

"Deposition of Amorphous Carbon Films from Laser–Produced Plasmas," *Mat. Res. Soc. Sump. Proc.*, vol. 38, (1985), pp. 326–335.

(List continued on next page.)

*Primary Examiner*—P. Austin Bradley
*Assistant Examiner*—Jeffrey T. Knapp
*Attorney, Agent, or Firm*—Kelly K. Kordzik; Winstead Sechrest & Minick P.C.

[57] ABSTRACT

A matrix addressable flat panel display includes a flat cathode operable for emitting electrons to an anode when an electric field is produced across the surface of the flat cathode by two electrodes placed on each side of the flat cathode. The flat cathode may consist of a cermet or amorphic diamond or some other combination of a conducting material and an insulating material such as a low effective work function material. The electric field produced causes electrons to hop on the surface of the cathode at the conducting-insulating interfaces. An electric field produced between the anode and the cathode causes these electrons to bombard a phosphor layer on the anode.

23 Claims, 6 Drawing Sheets

U.S. PATENT DOCUMENTS

| | | |
|---|---|---|
| 2,959,483 | 11/1960 | Kaplan . |
| 3,070,441 | 12/1962 | Schwartz . |
| 3,108,904 | 10/1963 | Cusano . |
| 3,259,782 | 7/1966 | Shroff . |
| 3,314,871 | 4/1967 | Heck et al. . |
| 3,360,450 | 12/1967 | Hays . |
| 3,481,733 | 12/1969 | Evans . |
| 3,525,679 | 8/1970 | Wilcox et al. . |
| 3,554,889 | 1/1971 | Hyman et al. . |
| 3,665,241 | 5/1972 | Spindt et al. . |
| 3,675,063 | 7/1972 | Spindt et al. . |
| 3,755,704 | 8/1973 | Spindt et al. . |
| 3,789,471 | 2/1974 | Spindt et al. . |
| 3,808,048 | 4/1974 | Strik . |
| 3,812,559 | 5/1974 | Spindt et al. . |
| 3,855,499 | 12/1974 | Yamada et al. . |
| 3,898,146 | 8/1975 | Rehkopf et al. . |
| 3,947,716 | 3/1976 | Fraser, Jr. et al. . |
| 3,970,887 | 7/1976 | Smith et al. . |
| 4,008,412 | 2/1977 | Yuito et al. . |
| 4,075,535 | 2/1978 | Genequand et al. . |
| 4,084,942 | 4/1978 | Villalobos . |
| 4,139,773 | 2/1979 | Swanson . |
| 4,141,405 | 2/1979 | Spindt . |
| 4,143,292 | 3/1979 | Hosoki et al. . |
| 4,164,680 | 8/1979 | Villalobos . |
| 4,168,213 | 9/1979 | Hoeberechts . |
| 4,178,531 | 12/1979 | Alig . |
| 4,307,507 | 12/1981 | Gray et al. . |
| 4,350,926 | 9/1982 | Shelton . |
| 4,482,447 | 11/1984 | Mizuguchi et al. . |
| 4,498,952 | 2/1985 | Christensen . |
| 4,507,562 | 3/1985 | Braunlich et al. . |
| 4,512,912 | 4/1985 | Matsuda et al. . |
| 4,513,308 | 4/1985 | Greene et al. . |
| 4,528,474 | 7/1985 | Kim . |
| 4,540,983 | 9/1985 | Morimoto et al. . |
| 4,542,038 | 9/1985 | Odaka et al. . |
| 4,578,614 | 3/1986 | Gray et al. . |
| 4,588,921 | 5/1986 | Tischer . |
| 4,594,527 | 6/1986 | Genevese . |
| 4,633,131 | 12/1986 | Khurgin . |
| 4,647,400 | 3/1987 | Dubroca et al. . |
| 4,663,559 | 5/1987 | Christensen ..... 313/336 |
| 4,684,353 | 8/1987 | deSouza . |
| 4,684,540 | 8/1987 | Schulze . |
| 4,685,996 | 8/1987 | Busta et al. . |
| 4,687,825 | 8/1987 | Sagou et al. . |
| 4,687,938 | 8/1987 | Tamura et al. . |
| 4,710,765 | 12/1987 | Ohkoshi et al. . |
| 4,721,885 | 1/1988 | Brodie . |
| 4,728,851 | 3/1988 | Lambe . |
| 4,758,449 | 7/1988 | Kimura et al. . |
| 4,763,187 | 8/1988 | Biberian . |
| 4,788,472 | 11/1988 | Katakami . |
| 4,816,717 | 3/1989 | Harper et al. . |
| 4,818,914 | 4/1989 | Brodie . |
| 4,822,466 | 4/1989 | Rabalais et al. . |
| 4,835,438 | 5/1989 | Baptist et al. . |
| 4,851,254 | 7/1989 | Yamamoto et al. . |
| 4,855,636 | 8/1989 | Busta et al. . |
| 4,857,161 | 8/1989 | Borel et al. . |
| 4,857,799 | 8/1989 | Spindt et al. . |
| 4,874,981 | 10/1989 | Spindt . |
| 4,882,659 | 11/1989 | Gloudemans . |
| 4,889,690 | 12/1989 | Lubbers et al. . |
| 4,892,757 | 1/1990 | Kasenga et al. . |
| 4,899,081 | 2/1990 | Kishino et al. . |
| 4,908,539 | 3/1990 | Meyer . |
| 4,923,421 | 5/1990 | Brodie et al. . |
| 4,926,056 | 5/1990 | Spindt . |
| 4,933,108 | 6/1990 | Soredal . |
| 4,940,916 | 7/1990 | Borel et al. . |
| 4,956,202 | 9/1990 | Kasenga et al. . |
| 4,956,573 | 9/1990 | Kane . |
| 4,964,946 | 10/1990 | Gray et al. . |
| 4,987,007 | 1/1991 | Wagal et al. . |
| 4,990,416 | 2/1991 | Mooney . |
| 4,990,766 | 2/1991 | Simms et al. . |
| 4,994,205 | 2/1991 | Towers . |
| 5,007,873 | 4/1991 | Goronkin et al. . |
| 5,015,912 | 5/1991 | Spindt et al. . |
| 5,019,003 | 5/1991 | Chason . |
| 5,036,247 | 7/1991 | Watanabe et al. . |
| 5,038,070 | 8/1991 | Bardai et al. . |
| 5,054,046 | 10/1991 | Shoulders . |
| 5,054,047 | 10/1991 | Shoulders . |
| 5,055,077 | 10/1991 | Kane . |
| 5,055,744 | 10/1991 | Tsuruoka . |
| 5,057,047 | 10/1991 | Greene et al. . |
| 5,063,323 | 11/1991 | Longo et al. . |
| 5,063,327 | 11/1991 | Brodie et al. . |
| 5,064,396 | 11/1991 | Spindt . |
| 5,075,591 | 12/1991 | Holmberg . |
| 5,075,595 | 12/1991 | Kane . |
| 5,075,596 | 12/1991 | Young et al. . |
| 5,079,476 | 1/1992 | Kane . |
| 5,085,958 | 2/1992 | Jeong . |
| 5,089,292 | 2/1992 | MaCaulay et al. . |
| 5,089,742 | 2/1992 | Kirkpatrick et al. . |
| 5,089,812 | 2/1992 | Fuse . |
| 5,090,932 | 2/1992 | Dieumegard et al. . |
| 5,098,737 | 3/1992 | Collins et al. . |
| 5,101,288 | 3/1992 | Ohta et al. . |
| 5,103,144 | 4/1992 | Dunham . |
| 5,103,145 | 4/1992 | Doran . |
| 5,117,267 | 5/1992 | Kimoto et al. . |
| 5,117,299 | 5/1992 | Kondo et al. . |
| 5,119,386 | 6/1992 | Narusawa . |
| 5,123,039 | 6/1992 | Shoulders . |
| 5,124,072 | 6/1992 | Dole et al. . |
| 5,124,558 | 6/1992 | Soltani et al. . |
| 5,126,287 | 6/1992 | Jones . |
| 5,129,850 | 7/1992 | Kane et al. . |
| 5,132,585 | 7/1992 | Kane et al. . |
| 5,132,676 | 7/1992 | Kimura et al. . |
| 5,136,764 | 8/1992 | Vasquez . |
| 5,138,237 | 8/1992 | Kane et al. . |
| 5,140,219 | 8/1992 | Kane . |
| 5,141,459 | 8/1992 | Zimmerman . |
| 5,141,460 | 8/1992 | Jaskie et al. . |
| 5,142,184 | 8/1992 | Kane . |
| 5,142,256 | 8/1992 | Kane . |
| 5,142,390 | 8/1992 | Ohta et al. . |
| 5,144,191 | 9/1992 | Jones et al. . |
| 5,148,078 | 9/1992 | Kane . |
| 5,148,461 | 9/1992 | Shoulders . |
| 5,150,011 | 9/1992 | Fujieda . |
| 5,150,192 | 9/1992 | Greene et al. . |
| 5,151,061 | 9/1992 | Sandhu . |
| 5,153,753 | 10/1992 | Ohta et al. . |
| 5,153,901 | 10/1992 | Shoulders . |
| 5,155,420 | 10/1992 | Smith . |
| 5,156,880 | 10/1992 | Wetzel et al. . |
| 5,157,304 | 10/1992 | Kane et al. . |
| 5,157,309 | 10/1992 | Parker et al. . |
| 5,162,704 | 11/1992 | Kobori et al. . |
| 5,166,456 | 11/1992 | Masahiko . |
| 5,173,634 | 12/1992 | Kane . |
| 5,173,635 | 12/1992 | Kane . |
| 5,173,697 | 12/1992 | Smith et al. . |
| 5,180,951 | 1/1993 | Dworsky et al. . |

| | | | |
|---|---|---|---|
| 5,183,529 | 2/1993 | Potter et al. . | |
| 5,185,178 | 2/1993 | Koskenmaki . | |
| 5,186,670 | 2/1993 | Doan et al. . | |
| 5,194,780 | 3/1993 | Meyer . | |
| 5,199,917 | 4/1993 | MacDonald et al. . | |
| 5,199,918 | 4/1993 | Kumar . | |
| 5,202,571 | 4/1993 | Hirabayashi et al. . | |
| 5,203,731 | 4/1993 | Zimmerman . | |
| 5,204,021 | 4/1993 | Dole . | |
| 5,204,581 | 4/1993 | Andreadakis et al. . | |
| 5,210,430 | 5/1993 | Taniguchi et al. . | |
| 5,212,426 | 5/1993 | Kane . | |
| 5,213,712 | 5/1993 | Dole . | |
| 5,214,347 | 5/1993 | Gray . | |
| 5,214,416 | 5/1993 | Kondo et al. . | |
| 5,220,725 | 6/1993 | Chan et al. . | |
| 5,227,699 | 7/1993 | Busta . | |
| 5,228,877 | 7/1993 | Allaway et al. . | |
| 5,228,878 | 7/1993 | Komatsu . | |
| 5,229,331 | 7/1993 | Doan et al. . | |
| 5,229,682 | 7/1993 | Komatsu . | |
| 5,231,606 | 7/1993 | Gray . | |
| 5,235,244 | 8/1993 | Spindt . | |
| 5,242,620 | 9/1993 | Dole et al. . | |
| 5,243,252 | 9/1993 | Kaneko et al. . | |
| 5,250,451 | 10/1993 | Chouan . | |
| 5,252,833 | 10/1993 | Kane et al. . | |
| 5,256,888 | 10/1993 | Kane . | |
| 5,259,799 | 11/1993 | Doan et al. . | |
| 5,266,155 | 11/1993 | Gray . | |
| 5,275,967 | 1/1994 | Taniguchi et al. . | |
| 5,276,521 | 1/1994 | Mori et al. . | |
| 5,277,638 | 1/1994 | Lee . | |
| 5,278,475 | 1/1994 | Jaskie et al. . | |
| 5,281,891 | 1/1994 | Kaneko et al. . | |
| 5,283,500 | 2/1994 | Kochanski . | |
| 5,285,129 | 2/1994 | Takeda et al. . | |
| 5,296,117 | 3/1994 | De Jaeger et al. . | |
| 5,302,423 | 4/1994 | Tran et al. . | |
| 5,312,514 | 5/1994 | Kumar . | |
| 5,315,393 | 5/1994 | Mican . | |
| 5,341,063 | 8/1994 | Kumar . | |
| 5,380,546 | 1/1995 | Kirshnan et al. . | |
| 5,399,238 | 3/1995 | Kumar . | |
| 5,445,550 | 8/1995 | Xie et al. | 445/24 |

OTHER PUBLICATIONS

"Development of Nano–Crystaline Diamond–Based Field–Emission Displays," *Society of Information Display Conference Technical Digest,* 1994, pp. 43–45.

"Diamond–like Carbon Films Prepared with a Laser Ion Source," *Appl. Phys. Lett.,* vol. 53, No. 3, Jul. 18, 1988, pp. 187–188.

"Diamond Cold Cathode," *IEEE Electron Device Letters,* vol. 12, No. 8, (Aug. 1989) pp. 456–459.

"Emission Spectroscopy During Excimer Laser Albation of Graphite," *Appl. Phys. Letters,* vol. 57, No. 21, Nov. 19, 1990, pp. 2178–2180.

"Enhanced Cold–Cathode Emission Using Composite Resin–Carbon Coatings," Dept. of Electronic Eng. & Applied Physics, Aston Univ., Aston Triangle, Birmingham B4 7ET, UK, May 29, 1987.

"High Temperature Chemistry in Laser Plumes," John L. Margrave Research Symposium, Rice University, Apr. 28, 1994.

"Laser Ablation in Materials Processing: Fundamentals and Applications," *Mat. Res. Soc. Symp. Proc.,* vol. 285, (Dec. 1, 1992), pp. 39–86.

"Laser Plasma Source of Amorphic Diamond," *Appl. Phys. Lett.,* vol. 54, No. 3, Jan. 16, 1989, pp. 216–218.

"Optical Characterization of Thin Film Laser Deposition Processes," *SPIE,* vol. 1594, *Process Module Metrology, Control, and Clustering* (1991), pp. 411–417.

"Optical Emission Diagnostics of Laser–Induced Plasma for Diamond–Like Film Deposition," *Appl. Phys.,* vol. 52A, 1991, pp. 328–334.

"Optical Observation of Plumes Formed at Laser Ablation of Carbon Materials," *Appl. Surface Science,* vol. 79/80, 1994, pp. 141–145.

"Spatial Characteristics of Laser Pulsed Plasma Deposition of Thin Films," *SPIE,* vol. 1352, *Laser Surface Microprocessing*(1989), pp. 95–99.

"The Bonding of Protective Films of Amorphic Diamond to Titanium," *J. Appl. Phys.,* vol. 71, No. 7, Apr. 1, 1992, pp. 3260–3265.

"Thermochemistry of Materials by Laser Vaporization Mass Spectrometry: 2. Graphite," *High Temperatures—High Pressures,* vol. 20, 1988, pp. 73–89.

"Angular Characteristics of the Radiation by Ultra Relativistic Electrons in Thick Diamond Single Crystals," *Sov. Tech. Phys. Lett.,* vol. 11, No. 11, Nov. 1985, pp. 574–575.

"Diamond Cold Cathodes: Applications of Diamond Films and Related Materials," Elsevier Science Publishers BN, 1991, pp. 309–310.

"Electron Field Emission from Amorphic Diamond Thin Films," *6th International Vacuum Microelectronics Conference Technical Digest,* 1993, pp. 162–163.

"Electron Field Emission from Broad–Area Electrodes," *Applied Physics* A 28, 1982, pp. 1–24.

"Emission Properties of Spindt–Type Cold Cathodes with Different Emission Cone Material", *IEEE Transactions on Electron Devices,* vol. 38, No. 10, Oct. 1991.

"Field Emission Displays Based on Diamond Thin Films," *Society of Information Display Conference Technical Digest,* 1993, pp. 1009–1010.

"Microstructure of Amorphic Diamond Films."

"Recent Development on 'Microtips' Display at LETI," *Technical Digest of IUMC 91,* Nagahama 1991, pp. 6–9.

"Sealed Vacuum Devices: Microchips Fluorescent Display," *3rd International Vacuum Microelectronics Conference,* Monterrey, U.S.A., Jul. 1990

"The Field Emission Display: A New Flat Panel Technology," CH–3071–9/91/0000–0012 501.00 1991 IEEE.

"Thin–Film Diamond," *The Texas Journal of Science,* vol. 41, No. 4, 1989, pp. 343–358.

"Use of Diamond Thin Films for Low Cost field Emissions Displays," *7th International Vacuum Microelectronics Conference Technical Digest,* 1994, pp. 229–232.

"Advances in Electronics and Electron Physics," Academnic Press, Inc., vol. 67, 1986, pp. 252, 272–273.

"Cathodoluminescence: Theory and Application," VCH Publishers, New York, 1990, Chapters 9 and 10.

"Cathodoluminescent Materials," *Electron Tube Design,* D. Sarnoff Res. Center Yearly Reports & Review, 1976, pp. 128–137.

"Electron Microscopy of Nucleation and Growth of Indium and Tin Films" *Philosophical Magazine,* vol. 26, No. 3, 1972, pp. 649–663.

"Improved Performance of Low Voltage Phosphors for Field Emission Displays," SID Display Manufacturing Conf., Santa Clara, CA., Feb. 2, 1995.

"Phosphor Materials for Cathode–Ray Tubes," *Advances in Electronics and Electron Physics*, vol. 17, 1990, pp. 271–351.
"The Chemistry of Artificial Lighting Devices," *Studies in Inorganic Chemistry 17*, Elsevier Science Publishers B.V., New York, 1993, pp. 573–593.
Data Sheet on Anode Drive SN755769, Texas Instruments, pp. 4–81 to 4–88.
Data Sheet on Display Driver, HV38, Supertex, Inc., pp. 11–43 to 11–50.
Data Sheet on voltage Driver, HV620, Supertex Inc., pp. 1–6, May 21, 1993.
Data Sheet on voltage Drive, HV 622, Supertex Inc., pp. 1–5, Sept. 22, 1992.
"Light Scattering from Aggregated Silver and Gold Films," *J. Opt. Soc. Am.*, vol. 64, No. 9, Sep. 1974, pp. 1190–1193.
"Method of Making Field Emission Tips Using Physical Vapor Deposition of Random Nuclei as Etch Mask," Serial No. 08/232,790 filed Apr. 22, 1994, now U.S. Pat. 5,399, 238.
"Method of Making Field Emission Tips Using Physical Vapor Deposition of Random Nuclei as Etch Mask," International Application No. PCT/US94/04568 filed Apr. 22, 1994.
"Amorphic Diamond Film Fiat Field Emission Cathode," Serial No. 08/071,157 filed Jun. 2, 1993.
"Diode Structure Flat Panel," Serial No. 07/995,846 filed Dec. 23, 1992, now U.S. Pat. 5,449,970.
"Triode Structure Flat Panel Display Employing Flat Field Emission Cathodes," Serial No. 07/993,863 filed Dec. 23, 1992. FWC→08/458,854→U.S. Pat. 5,548,185.
"System and Method for Achieving Uniform Screen Brightness Within a Matrix Display," Serial No. 08/292,135 filed Aug. 17, 1994.
"Method for Producing Thin, Uniform Powder Phosphor for Display Screens," Serial No. 08/304,918 filed Sep. 13, 1994, now U.S. Pat. 5,531,880.
"Method of Making a Field Emission Electron Source with Random Micro–tip Structures," Serial No. 08/427,464 filed Apr. 24, 1995.
"Flat Panel Display Based on Diamond Thin Films," Serial No. 08/326,302 filed Nov. 19, 1994, now U.S. Pat. 5,551, 903.
"System and Method for Depositing a Diamond–like Film on a Substrate," Serial No. 08/320,626 filed Nov. 7, 1994.
"A Field Emission Display Device," Serial No. 08/456,453 filed Jun. 23, 1994, now U.S. Pat. 5,536,193.
"Pretreatment Process for a Surface Texturing Process," Serial No. 08/427,462 filed Apr. 24, 1995.
"Field Emitter with Wide Band Gap Emission," Serial No. 08/264,386 filed Jun. 23, 1994, now U.S. Pat. 5,536,193.

METHOD OF MAKING A FIELD EMITTER

RELATED APPLICATIONS

This application is a continuation-in-part of Ser. No. 07/993,863, which was filed on Dec. 23, 1992, now abandoned, which is a continuation-in-part of Ser. No. 07/851,701, filed Mar. 16, 1992, which was abandoned and refiled as a continuation application Ser. No. 08/300,771, filed Jun. 20, 1994. These applications are incorporated herein by reference.

CROSS REFERENCE TO RELATED APPLICATION

This application for patent is related to the following application for patent filed concurrently herewith:

A FIELD EMISSION DISPLAY DEVICE, Ser. No. 08/456,453, filed Jun. 1, 1995.

TECHNICAL FIELD OF THE INVENTION

This invention relates in general to flat panel displays for computers and the like, and, more particularly, to flat panel displays that are of a field emission type with flat cathode emitters.

BACKGROUND OF THE INVENTION

Field emission computer displays, in the general sense, are not new. For years there have been displays that comprise a plurality of field emission cathodes and corresponding anodes (field emission devices ("FEDs")), the anodes emitting light in response to electron bombardment from the corresponding cathodes.

For a discussion on the nature of field emission, please refer to the referenced parent application, Ser. No. 07/993,863, which is hereby incorporated by reference herein.

Micro-tipped cathodes have been well-known in the art for several years. Please refer to U.S. Pat. Nos. 3,665,241, 3,755,704, 3,789,471, 3,812,559, 4,857,799, and 5,015,912, each issued to Spindt, et al., for teachings of micro-tipped cathodes and the use of micro-tipped cathodes within triode pixel (three electrodes) displays.

Referring to FIG. 1, there is illustrated a portion of a display device 10 produced in accordance with the prior art teachings of micro-tipped cathodes. Display 10 includes an anode comprising glass substrate 15, conductive layer 20 and phosphor layer 16, which may comprise any known phosphor material capable of emitting photons in response to bombardment by electrons.

The cathode comprises substrate 11, which may be comprised of glass, on which micro-tip 12 has been formed. Micro-tip 12 has often been comprised of a metal such as molybdenum, or a semiconductor material such as silicon, or a combination of molybdenum and silicon. A metal layer 17 may be deposited on substrate 11. Metal layer 17 is conductive and operable for providing an electrical potential to the cathode. Dielectric film 13 is deposited on top of metal layer 17. Dielectric layer 13 may comprise an silicon-oxide material.

A second electrode 14 is deposited upon dielectric layer 13 to act as a gate electrode for the operation of display 10.

Device 10 operates by the application of an electrical potential between gate electrode 14 and layer 17 to cause the field emission of electrons from micro-tip 12 to phosphor layer 16. Note, an electrical potential may also be applied to metal layer 20 between glass substrate 15 and phosphor layer 16. One or more of anode conductive layer 20, gate electrode 14 and metal layer 17 may be individually addressable in a manner so that pixels within a display may be individually addressed in a matrix addressable configuration.

Referring next to FIG. 2, there is shown an alternative embodiment of display 10 wherein micro-tip 12 is comprised of a submicro-tip 18 which may consist of such materials as a conductive metal (e.g., molybdenum) with layer 19 formed thereon. Layer 19 has typically comprised any well-known low work function material.

As was discussed in Ser. No. 07/993,863 referenced above, fabrication of micro-tip cathodes requires extensive fabrication facilities to finely tailor the micro-tips to a conical shape. At the same time, it is very difficult to build large area field emitters because cone size is limited by the lithography equipment. In addition, it is difficult to perform very fine feature lithography on large area substrates, as required by flat panel display type applications.

The viability of producing a flat cathode using amorphic diamond thin films and building diode structure field emission display panels using such cathodes has been shown in U.S. patent application Ser. No. 07/995,846, now U.S. Pat. No. 5,449,970, which is also a continuation-in-part application of Ser. No. 07/851,701 referenced above. Ser. No. 07/995,846 is owned by a common assignee of the present invention. Ser. No. 07/995,846 is hereby incorporated by reference herein. Such flat cathodes overcome many of the above-noted problems associated with micro-tipped cathodes.

However, diode structure FED panels require high voltage drivers, increasing the overall display system cost. In addition, this forces the use of lower anode voltages, which limits the maximum panel efficiency and brightness.

Thus, there is a need in the art to develop an FED pixel structure that will work with flat cathodes and will not require fine conical or pyramid-shaped features (i.e., micro-tipped cathodes), yet overcomes the problems associated with diode structure FED panels.

SUMMARY OF THE INVENTION

The present invention satisfies the foregoing needs by providing a flat panel display comprising a flat cathode that is thinner than prior flat cathode structures.

The pixel structure is produced by coating an appropriate substrate with a thin strip of a non-homogenous low effective work function ("LWF") material such as a cermet, CVD (chemical vapor deposition) diamond films, aluminum nitrite, gallium nitrite, or areorphic diamond. When a low voltage is applied to metal contacts attached to the two ends of the thin strip, electrons flow under the applied electric field atop the LWF strip. Due to the non-homogenous nature of the cathode film, electrons hop across the conducting-insulating interface(s) integrated within the LWF material. It is well known that electrons will "hop" across such a conducting-insulating interface in materials having such interfaces such as those materials listed above. Such a phenomenon is sometimes referred to as "hopping conduction." If the insulating phase has a low or negative electron affinity, a fraction of these electrons can be removed by a very low electric field applied with the help of a third electrode associated with the anode placed above the cathode strip. A thin film of 100–10,000 angstroms thickness may be used in such a structure. The minimum feature sizes are on the order of a pixel size, and no micro-tips or grid structures are needed.

The above pixel structure can be used to fabricate a cathode plate for a matrix addressable FED panel.

The present invention may be referred to as having a triode structure (three terminals, or electrodes), though the structure of the present invention is dissimilar to typical triode structure FEDs.

Advantages of the present invention include low power dissipation, high intensity and projected low cost to manufacture. Another advantage of the present invention is that a reduced driver voltage is required increasing the power efficiency of a resultant display panel.

Yet another advantage of the present invention is that the cathode structure has a less number of layers than prior flat cathode tdode structures, resulting in reduced manufacturing time.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWING

For a more complete understanding of the present invention, and the advantages thereof, reference is now made to the following descriptions taken in conjunction with the accompanying drawings, in which.

DETAILED DESCRIPTION OF A PREFERRED EMBODIMENT OF THE INVENTION

Figure 1:
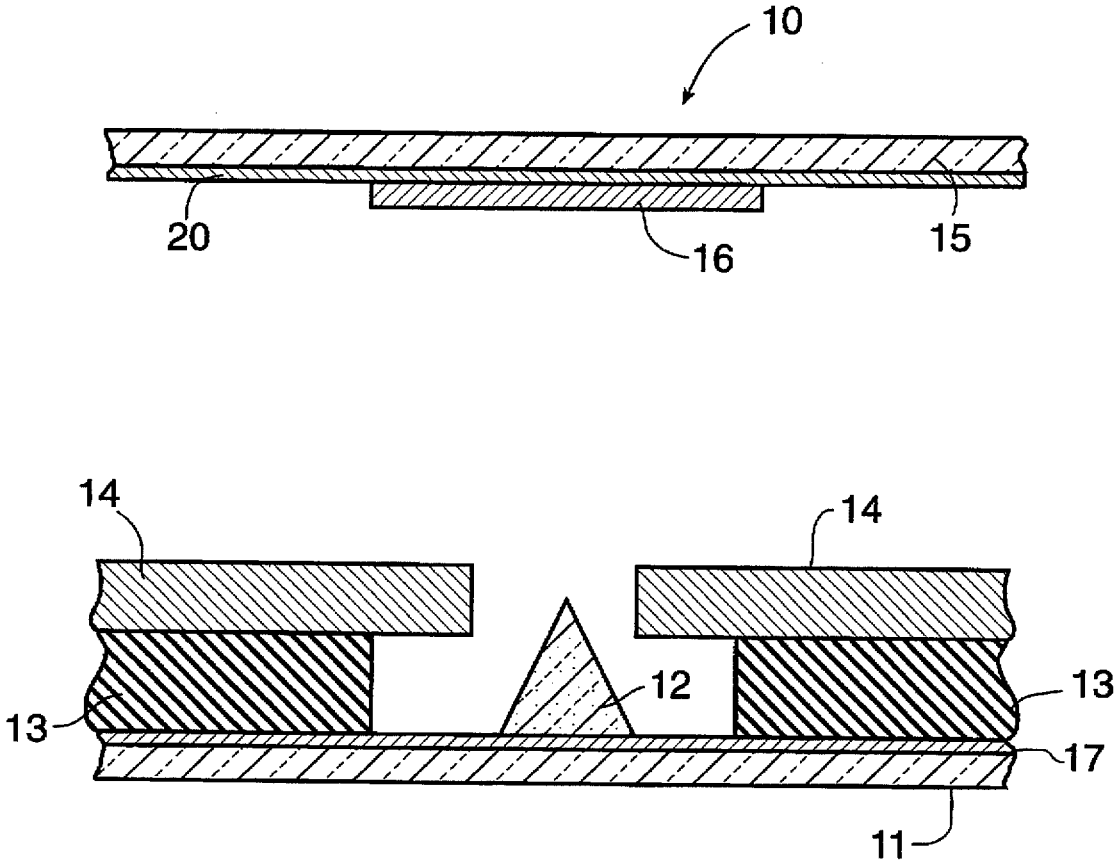
FIG. 1 PRIOR ART
FIG. 1 illustrates a prior art triode structure FED pixel.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Refer now to the drawings wherein depicted elements are not necessarily shown to scale and wherein like or similar elements are designated by the same reference numeral through the several views.

Figure 3:
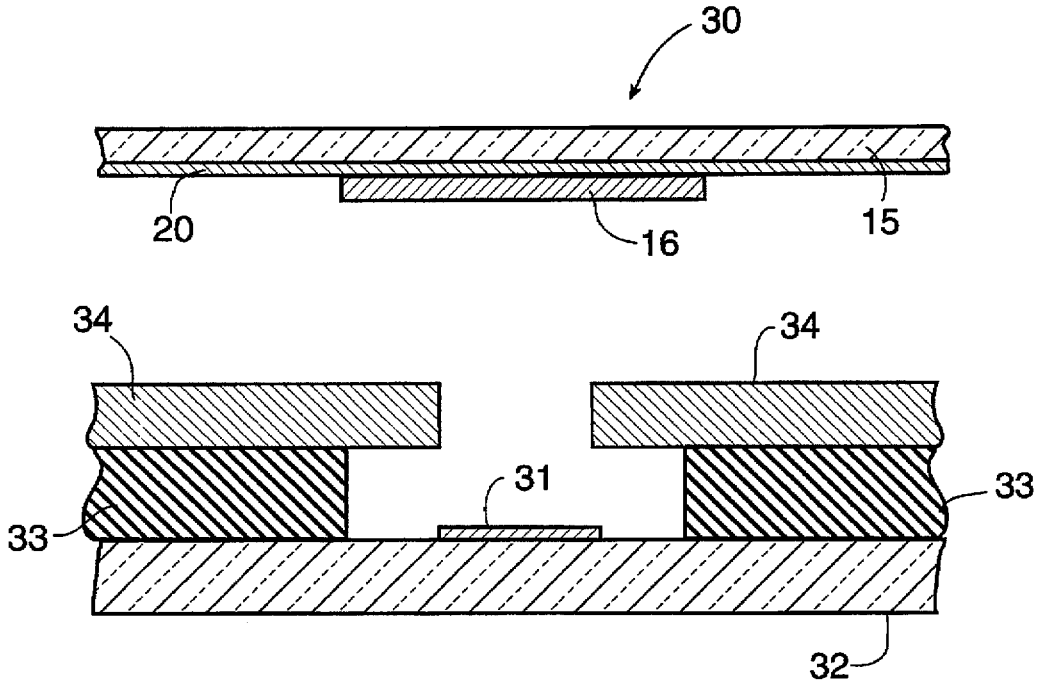
FIG. 3 illustrates a portion of a flat cathode triode structure pixel.

Referring to FIG. 3, there is illustrated a portion of a flat panel display comprising a triode structure pixel employing a flat cathode as disclosed within Ser. No. 07/993,863.

Display 30 comprises an anode which may be configured in the same way as described earlier. The anode may comprise a glass substrate 15, with a conductive layer 20 disposed thereover and a phosphor layer 16 disposed over conductive layer 20. An electrical potential may be applied to conductive layer 20 for producing the required electric field as described below.

Figure 2:
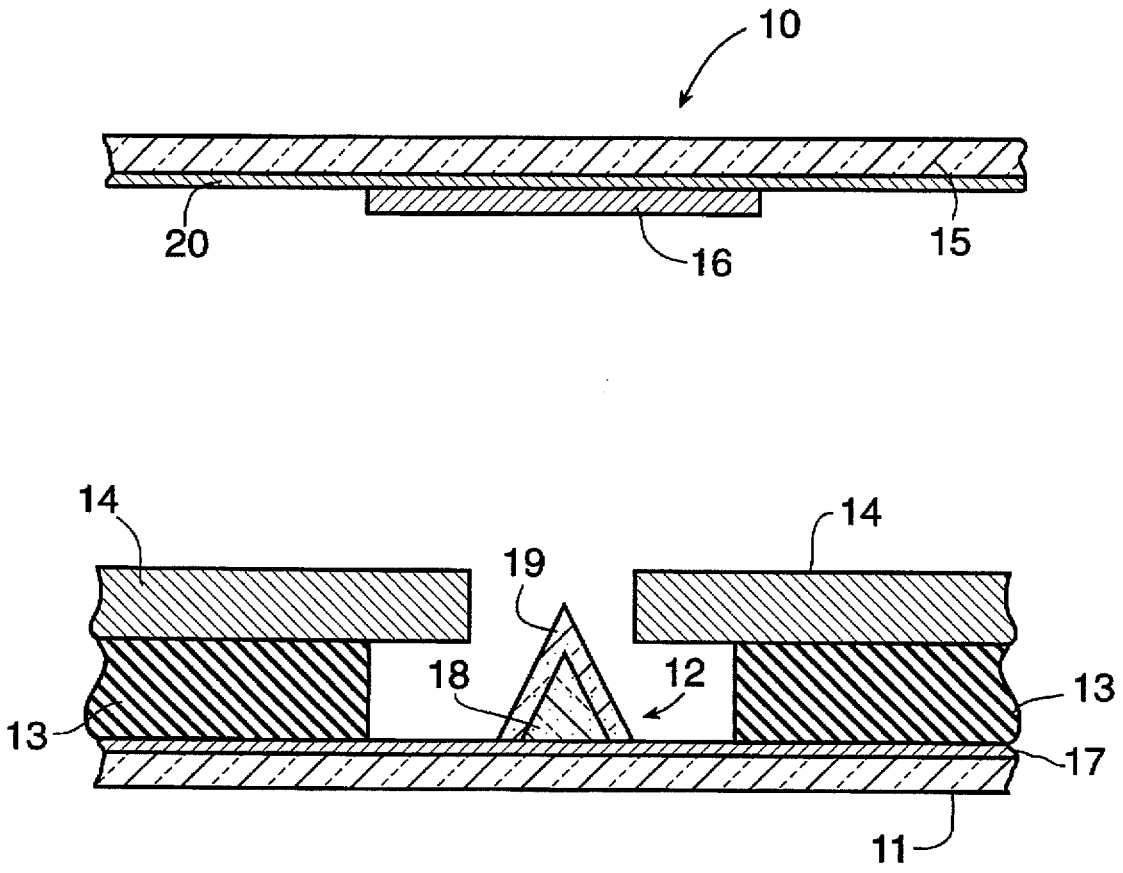
FIG. 2 PRIOR ART
FIG. 2 illustrates another prior art triode structure FED pixel.

The cathode comprises substrate 32, which may have a conductive layer (not shown) deposited thereon, such as shown in FIG. 2. Flat cathode emitter 31 is then deposited and may comprise a low effective work function material such as amorphic diamond. Dielectric film 33 is then deposited on substrate 32 in order to support gate electrode 34. Electrical potentials may be applied to conductive layer 20, gate electrode 34 and the conducting layer on substrate 32 (not shown). The operation of display 30 is as described within Ser. No. 07/993,863.

Figure 4:
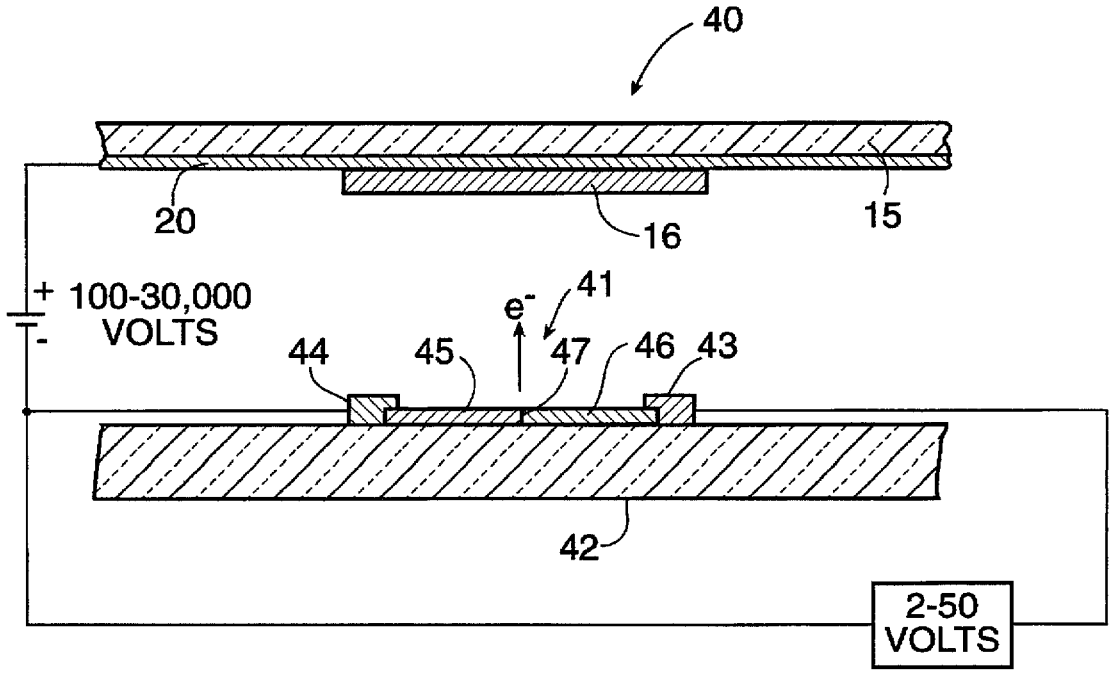
FIG. 4 illustrates one embodiment of the present invention.

Referring next to FIG. 4, there is illustrated a portion of display 40 configured in accordance with the teachings of the present invention. Display 40 is somewhat based upon the structure and operation of display 30.

The anode is as described above with respect to FIG. 3.

The cathode comprises substrate 42 which may consist of glass, whereon a thin layer 41 of a non-homogenous LWF material such as cermet, CVD diamond films, aluminum nitrite, gallium nitrite, or amorphic diamond has been deposited thereon. Cermet is an acronym for ceramic and metal, which may be a mixture of an insulating material and a highly conducting material. Amorphic diamond is as described in Ser. Nos. 07/993,863 and 07/995,846 referenced above.

In FIG. 4, layer 41 comprises two primary portions 45 and 46. There may be one each of portions 45 and 46 within layer 41 or a plurality of each. Portion 45 comprises a metal or conductive material (e.g., aluminum, chromium, titanium, molybdenum, graphite), while portion 46 may comprise an insulating material e.g., diamond, amorphic diamond, aluminum nitrite, gallium nitrite, silicon dioxide). What is essential is the interface 47 between materials 45 and 46. It is conducting-insulating interface 47 where electrons are released upon an application of an electric field (a few volts to 50 volts) between conducting strips 43 and 44. These electrons are then attracted to phosphor layer 16 by an electric field (100–30,000 volts) between the anode and cathode, which is assisted by the application of a potential to conducting layer 20 in the anode.

FIG. 4 illustrates that pixel 40 is operable with only one conducting-insulating interface within cathode 41.

Cathode 41 may be fabricated using the following described process. Note, the structures illustrated in FIGS. 5 and 6 may also be constructed using the following fabrication process.

Substrate 42, which may be glass or ceramic, is coated with a thin layer, typically 0.001–1 micron thick, of LWF material using any one of several appropriate deposition techniques. This is followed by a standard photolithographic process, involving coating of a photoresist, exposure through a mask, development of the photoresist, and etching of the LWF material in order to define the LWF layer into pixel or sub-pixel sized strips or patches of cathode 41. (In FIG. 6, such a pixel patch is shown as item 51.) This is followed by a metal contact deposition followed by a standard photolithography to define the electrical contact areas 43 and 44.

An alternative fabrication method could include fabrication of metal contact areas 43 and 44 over substrate 42 prior to depositing LWF patches 41. LWF patches 41 may be fabricated by use of shadow mask techniques instead of photolithography.

Figure 5:
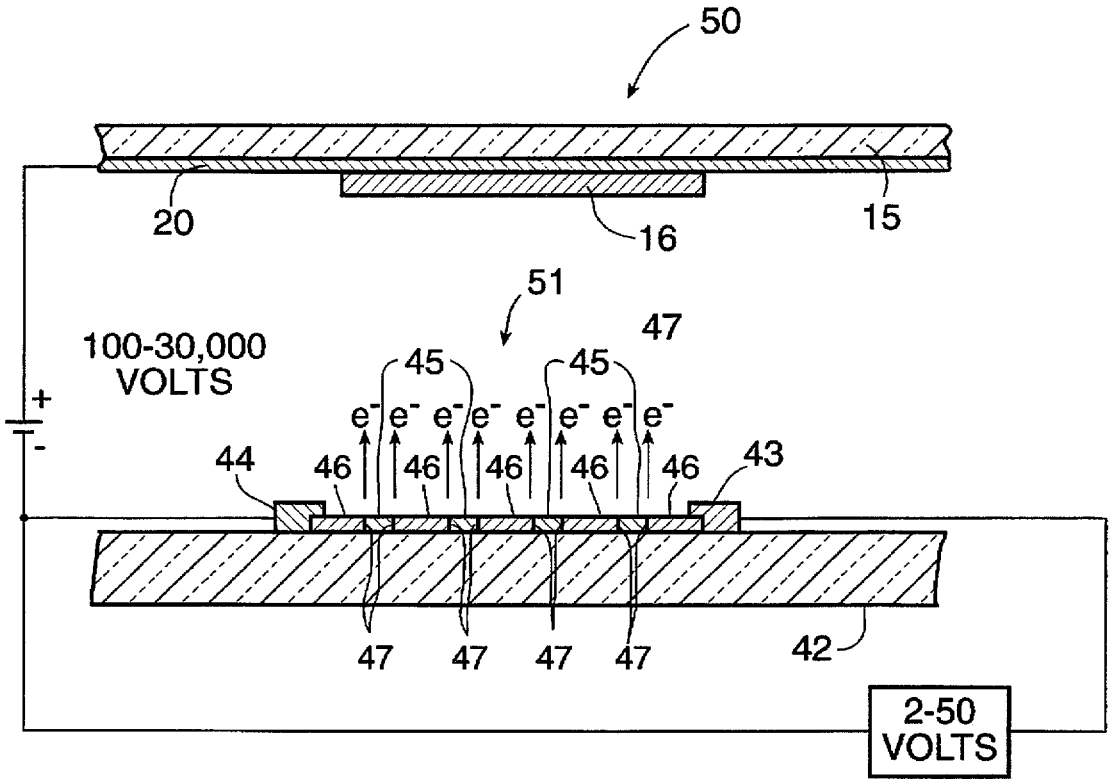
FIG. 5 illustrates a second embodiment of the present invention.

Referring next to FIG. 5, there is shown another embodiment of the present invention whereby pixel 50 comprises an anode similar to the one described with respect to FIG. 4 and a cathode, which may be comprised with layer 51 of cermet or amorphic diamond. The cermet or amorphic diamond may have many interfaces 47 between conducting material 45 and insulating material 46. These conducting-insulating interfaces 47 have electrons hop up from the interface 47 due to a low voltage applied across metal contacts 43 and 44. These electrons are then caused to bombard phosphor layer 16 by the application of a voltage between the anode and cathode as described above. Electrodes 43 and 44 may be comprised of aluminum, chromium, titanium, molybdenum, or graphite. Electrode layer 20 may be comprised of indium tin oxide (ITO).

Figure 6:
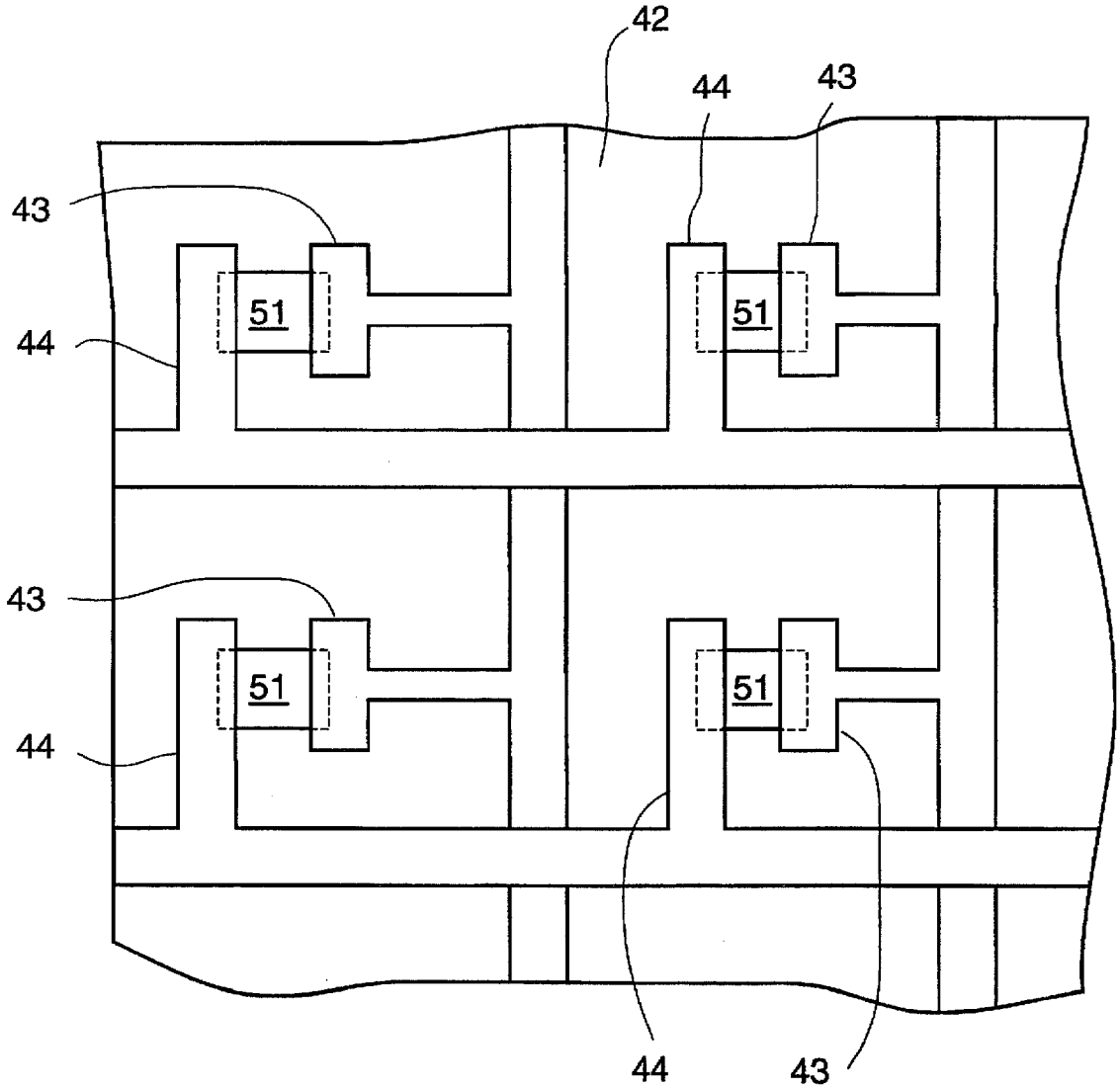
FIG. 6 illustrates a portion of a cathode or a flat panel display implemented in accordance with the present invention.

Referring next to FIG. 6, there is illustrated a portion of a matrix addressable flat panel display. The portion illustrated is a top view of four pixels (e.g., pixel 40 or 50) addressable in a manner well-known in the art. As can be seen, a cathode layer 51 may be addressed by the application of a voltage potential across electrodes 43 and 44 in a matrix-addressable manner. Note, cathode layer 51 may be replaced by cathode layer 41, shown in FIG. 4.

The matrix addressing of pixels may be performed as discussed within Ser. No. 07/995,846 or U.S. Pat. No. 5,015,912, which is hereby incorporated by reference herein.

Figure 7:
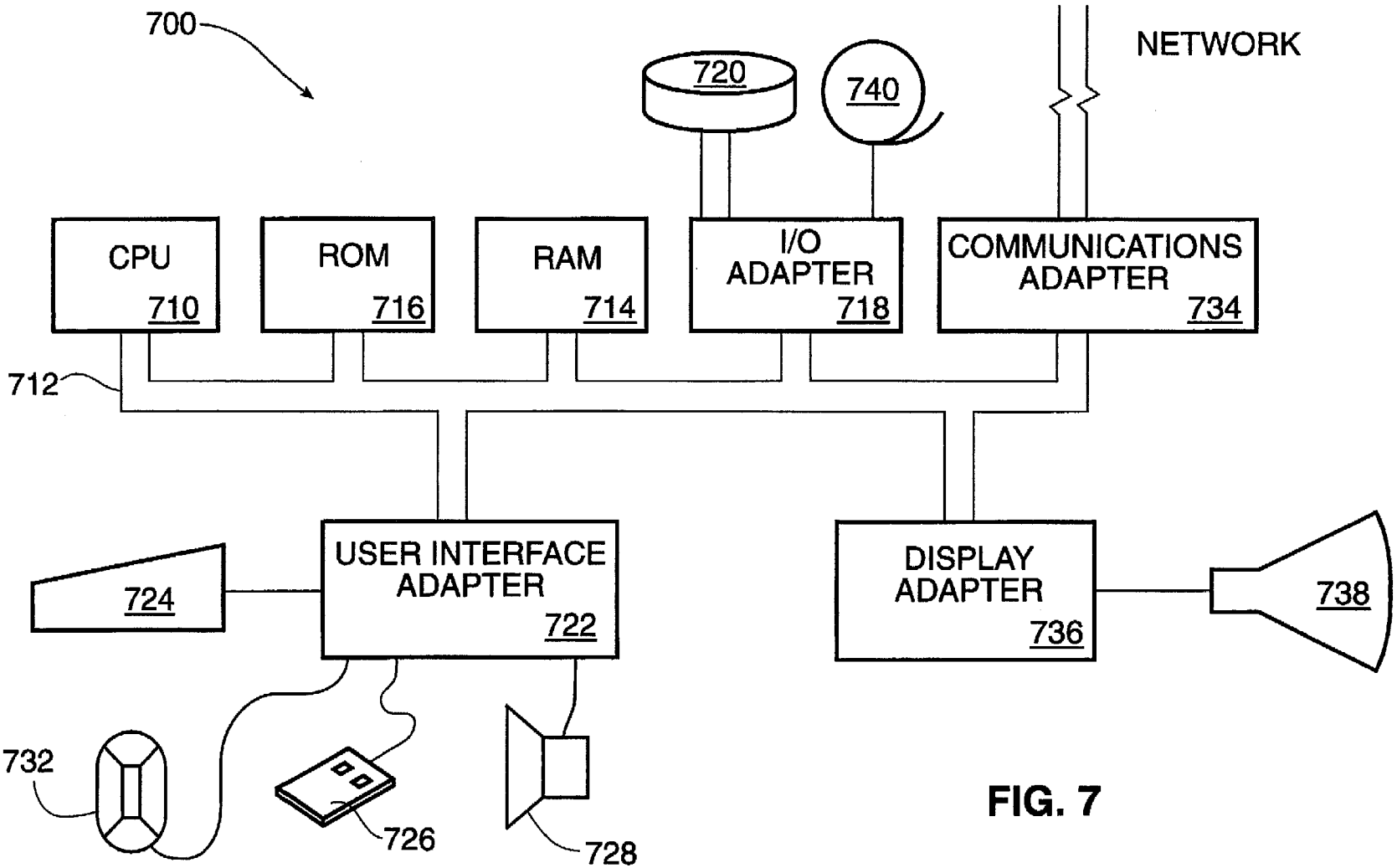
FIG. 7 illustrates a data processing system in accordance with the present invention.

A representative hardware environment for practicing the present invention is depicted in FIG. 7, which illustrates a typical hardware configuration of a workstation in accordance with the subject invention having central processing unit 710, such as a conventional microprocessor, and a number of other units interconnected via system bus 712. The workstation shown in FIG. 7 includes random access memory (RAM) 714, read only memory (ROM) 716, and input/output (I/O) adapter 718 for connecting peripheral devices such as disk units 720 and tape drives 740 to bus 712, user interface adapter 722 for connecting keyboard 724, mouse 726, speaker 728, microphone 732, and/or other user interface devices such as a touch screen device (not shown) to bus 712, communication adapter 734 for connecting the workstation to a data processing network, and display adapter 736 for connecting bus 712 to display device 738.

Display device 738 may be configured as an FED display in accordance with the teachings of the present invention.

Although the present invention and its advantages have been described in detail, it should be understood that various changes, substitutions and alterations can be made herein without departing from the spirit and scope of the invention as defined by the appended claims.

What is claimed is:

1. A method of making a field emitter device, comprising the steps of:

providing a substrate;

depositing a layer of a low effective work function material on said substrate;

depositing a first layer of a conductive material in a first location near said layer of said low effective work function material; and depositing a second separate layer of said conductive material in a second location near said layer of said low effective work function material, said first and second locations positioned relative to each other and to said layer of said low effective work function material so that said first and second layers of said conductive material are operable to produce an electric field across a surface of said layer of said low effective work function material when a voltage potential is applied between said first and second layers of said conductive material.

2. The method as recited in claim 1, wherein said low effective work function material is non-homogenous.

3. The method as recited in claim 1, wherein said low effective work function material is a cermet.

4. The method as recited in claim 1, wherein said low effective work function material is amorphic diamond.

5. The method as recited in claim 1, wherein said low effective work function material is CVD diamond film.

6. The method as recited in claim 1, wherein said layer of said low effective work function material is a thin film between 100 and 10,000 angstroms thick.

7. The method as recited in claim 1, wherein said first and second locations are each adjacent to said layer of said low effective work function material on opposite sides of said layer of said low effective work function material.

8. The method as recited in claim 1, wherein said conductive material is chromium.

9. The method as recited in claim 1, wherein said conductive material is titanium.

10. The method as recited in claim 1, wherein said layer of said low effective work function material has a substantially flat upper surface.

11. The method as recited in claim 10, wherein said substantially flat upper surface is substantially parallel to an upper surface of said substrate.

12. A method of making a display device comprising the steps of:

depositing a patch of a low effective work function material on a substrate;

depositing on said substrate a first contact of conductive material adjoining a first side of said patch of said low effective work function material; and depositing on said substrate a second contact of conductive material adjoining a second side of said patch of said low effective work function material.

13. The method as recited in claim 12, further comprising the steps of:

positioning an anode substrate a distance away from said substrate supporting said low effective work function material;

depositing a conductive material on said anode substrate; and depositing a luminescent material on said conductive material deposited on said anode substrate.

14. The method as recited in claim 12, wherein said layer of said low effective work function material has a substantially flat upper surface.

15. The method as recited in claim 14, wherein said substantially flat upper surface is substantially parallel to an upper surface of said substrate.

16. The method as recited in claim 12, wherein said first and second contacts of conductive material are formed so that they are operable for producing an electric field across a surface of said low effective work function material when a voltage potential is applied between said first and second contacts of conductive material.

17. The method as recited in claim 16, wherein said steps of depositing on said substrate said first and second contacts of conductive material are performed during the same deposition process.

18. The method as recited in claim 16, wherein said steps of depositing on said substrate said first and second contacts of conductive material are performed before said step of depositing said patch of said low effective work function material on said substrate.

19. The method as recited in claim 12, wherein said low effective work function material is non-homogenous, having at least one conducting-insulating interface.

20. The method as recited in claim 19, wherein said low effective work function material is a cermet.

21. The method as recited in claim 19, wherein said low effective work function material is amorphic diamond.

22. The method as recited in claim 19, wherein said low effective work function material is CVD diamond film.

23. The method as recited in claim 19, whereto said layer of said low effective work function material is a thin film between 100 and 10,000 angstroms thick.

* * * * *